United States Patent [19]

Pototsky et al.

[11] 4,069,876

[45] Jan. 24, 1978

[54] HYDRAULIC PERCUSSIVE MACHINE

[76] Inventors: Vasily Borisovich Pototsky, 4 Linia, 208, Alma-Ata; Nikolai Radionovich Petrenko, bulvar Ryabinova 49, kv. 17, Irkutsk, both of U.S.S.R.

[21] Appl. No.: 614,551

[22] Filed: Sept. 18, 1975

[51] Int. Cl.[2] ..... E21C 1/12

[52] U.S. Cl. ..... 173/119; 91/231; 91/341 R; 173/73; 173/80

[58] Field of Search ..... 91/321, 341 R, 344; 173/73, 119, 80

[56] References Cited

U.S. PATENT DOCUMENTS

| | | | |
|---|---|---|---|
| 1,605,713 | 11/1926 | Gilman | 173/105 |
| 2,937,619 | 5/1960 | Kurt | 173/73 X |
| 3,095,046 | 6/1963 | Mori | 173/73 X |
| 3,162,251 | 12/1964 | Bassinger | 173/80 X |
| 3,692,122 | 9/1972 | Curington | 173/119 |

*Primary Examiner*—Ernest R. Purser
*Assistant Examiner*—William F. Pate, III
*Attorney, Agent, or Firm*—Lackenbach, Lilling & Siegel

[57] ABSTRACT

A machine having a housing wherein are arranged a stepped hammer piston adjoining the front portion of the machine and a stepped plunger adjoining the rear portion of said machine, said hammer piston and plunger being adapted for an axial movement in said housing. The hammer piston and the plunger are separated by resilient means. The pressure fluid fed into the housing provides for reciprocation of the hammer piston and the plunger. The hammer piston reciprocations consist of forward and return strokes. During the forward stroke the hammer piston transmits impacts to the tool. The presence of the hammer piston and the plunger with the resilient member in between increases the power of the hammer piston impacts transmitted to the tool, hence the machine efficiency. The machine may be advantageously used as a hydraulic hammer (quartering hammer) and a hydraulic percussive device for making holes and deep wells in soil.

2 Claims, 6 Drawing Figures

HYDRAULIC PERCUSSIVE MACHINE

The present invention relates to a hydraulic percussive machine which may be used as a hydraulic hammer for destroying various constructions, forging parts, driving in piles etc. and, when employing a means for rotating said machine via a drill rod, for making holes and deep wells in soil in mining, tunelling, construction work and the like.

Known in the art is a hydraulic percussive machine comprising: a housing with passages for fluid and a stepped hammer piston adapted to move axially in said housing and adjoining with its larger diameter portion the front portion of the machine. The piston hammer is pressed by a resilient member against the front portion of the machine and is reciprocated by the pressure fluid to effect forward and return strokes. During its forward strokes the hammer piston applies impacts to an anvil of a tool installed in the housing at the front portion of the machine. The hydraulic machine is provided with a stepped pressure difference ring valve fitted over the hammer piston and reciprocating to distribute the fluid between the return space of the housing and the atmosphere.

The stepped hammer piston of the known hydraulic percussive machine is made as an integral part with two steps of different diameters and with a smaller area end face of the hammer piston step being in the rear portion space of the housing which is in constant communication with the pressure pipeline. With the ring valve being in the foremost position (towards the tool), its passages communicate with the passage in the housing whereby the return space is connected to the pressure pipeline. The pressure fluid enters the return space and effects the return stroke of the hammer piston by compressing a spring arranged between the head face of the hammer-piston larger diameter step and an annular projection of the housing. At the end of the return stroke (away from the tool) the hammer piston touches the inner annular projection of the valve by its outer annular projection and separates the valve from the anvil that causes the valve, due to the difference in the end face areas to move backward under the action of the fluid (away from the tool) thus opening the discharge passages. The valve passages are overlapped by the side cylindrical walls of the housing and the return space is disconnected from the pressure pipeline thus resulting in a hydraulic shock above the hammer piston and in the pressure pipeline. The combined action of the hydraulic shock, excess pressure of the fluid against the hammer piston smaller diameter step end face, and of the releasing spring makes the hammer piston accomplish the forward stroke expelling the fluid from the return space outside. At the end of said stroke the hammer piston shifts the valve to the foremost position towards the tool to shut off the discharge passages and strikes the anvil connected with the tool. The stoppage of the hammer piston results in the second hydraulic shock in the pipeline, said shock plus the luid excess pressure causing the hammer piston to effect its return stroke and the cycle repeats.

A disadvantage of said hydraulic percussive machine resides in that the steps of its hammer piston are interconnected rigidly, being an integral part, thereby increasing energy losses of the hydraulic shocks in the pressure pipeline and necessitating a special compensator (cavity) for damping hydraulic shocks in the hose or string of drilling pipes which deliver the pressure fluid to said machine. The compensator consumes a part of the hydraulic shock energy, complicates the design of the hydraulic machine and reduces the operational stability thereof.

The object of the present invention is to provide a hydraulic percussive machine of a simple design.

Another object of the invention is to provide a hydraulic machine reliable in operation.

Still another object of the invention is to provide a hydraulic machine with a reduced weight and a minimum number of parts.

The principle object of the invention is to provide a hydraulic machine with increased efficiency.

Yet another object of the invention is to provide a hydraulic machine which might be used as a hydraulic hammer, and also when employing a rotating means, for drilling holes and deep wells.

These and other objects of the invention are achieved by providing a hydraulic percussive machine, comprising: a housing with passages for fluid; a stepped hammer piston adapted to move axially in said housing, pressed resiliently with its larger diameter step against the front portion of the machine and reciprocating under the action of the pressure fluid to effect forward and return strokes and to apply impacts during said forward strokes against an anvil linked with a tool mounted in the housing at the front portion of the machine; and a stepped pressure difference ring valve fitted over the hammer piston and adapted to reciprocate for distributing the pressure fluid between the return space and the atmosphere. According to the present invention, the hammer piston is divided into two different diameter portions, a larger diameter portion being the hammer piston, and a smaller diameter portion being the plunger, and resilient means is arranged between said portions.

It is preferable that the separated hammer piston end face facing the rear portion of the machine have a longitudinal cylindrical chamber whose section area is smaller than the back face area, that an axial cylindrical chamber is provided at the rear portion of the machine housing, and that a plunger is made hollow and has a hollow cylinder at one side thereof arranged to be axially movable in said cylindrical chamber of the hammer piston and at the other end a hollow cylinder, also adapted to be axially movable in said space of the housing, whose section area is smaller than the area of the piston back face, the area of the hollow cylinder end face located in the housing space exceeding the area of the end face of the hollow cylinder arranged in the cylindrical chamber of the hammer piston.

Such a design provides for transmitting the hydraulic shocks by a direct flow of the fluid to the bottom of the axial cylindrical chamber of the separated hammer piston, and, via the plunger, to the resilient member that increases the machine efficiency and rules out the necessity of a compensator for damping hydraulic shocks in the pressure pipeline running to the machine. Besides, the above design provides for reducing the overall dimensions of the machine.

It is preferable that the outer side surface of the separated hammer piston be provided with an annular projection and the inner surface of the housing with a corresponding step, said projection and said step forming an annular chamber; the housing wall at this step has passages connecting the annular chamber with the atmosphere when said hammer piston is in the direction to the tool, during its idle stroke said hammer piston compressing the air received in the annular chamber through said passages and delivering it through an annular gap between the housing and said hammer piston to the space between the separated hammer piston and the plunger, wherein said compressed air serves as a resilient member, thus ensuring automatic supply of the compressed air to said chamber of the housing and creating the resilient member without the necessity for an additional compensator under the hammer piston, thereby increasing the machine efficiency and ruling out the spring whose service life is considerably shorter than the member which has a practically unlimited life.

It is also possible to embody the resilient member arranged between the separated hammer piston and the plunger in the form of a compression spring which should be done when employing compressed air is difficult, for instance, while using the hydraulic percussive machine as a submersible apparatus for drilling deep flooded wells.

This invention discloses a reliable hydraulic percussive machine of a simpler design, lesser weight and higher efficiency than the known machines of the similar type. This hydraulic machine may be advantageously used as a hydraulic hammer (quartering hammer) and a hydraulic percussive device for making holes and deep wells in soil.

The invention is explained hereinbelow by way of examples with reference to the accompanying drawings, wherein.

Figure 1:
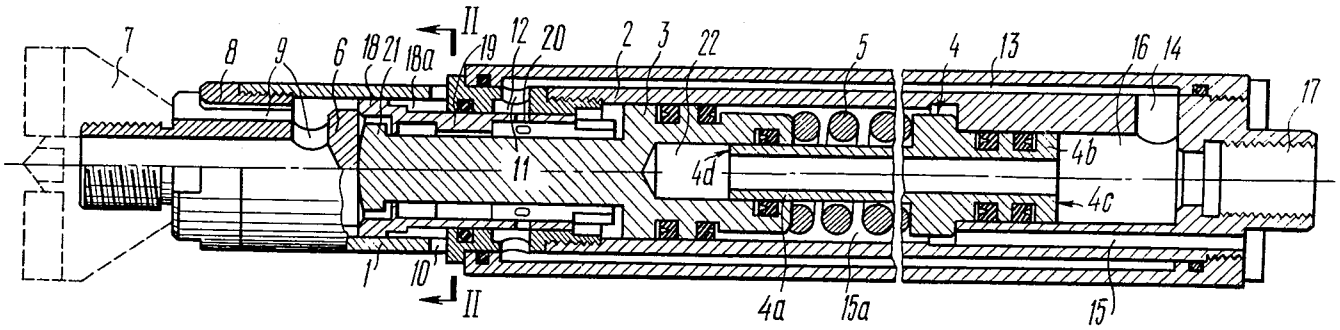
FIG. 1 is a longitudinal sectional view of the hydraulic percussive machine according to the invention.
Figure 2:
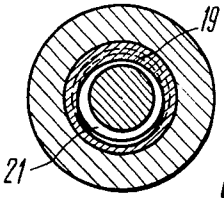
FIG. 2 is a cross-sectional view taken along the line II—II of FIG. 1.
Figure 3:
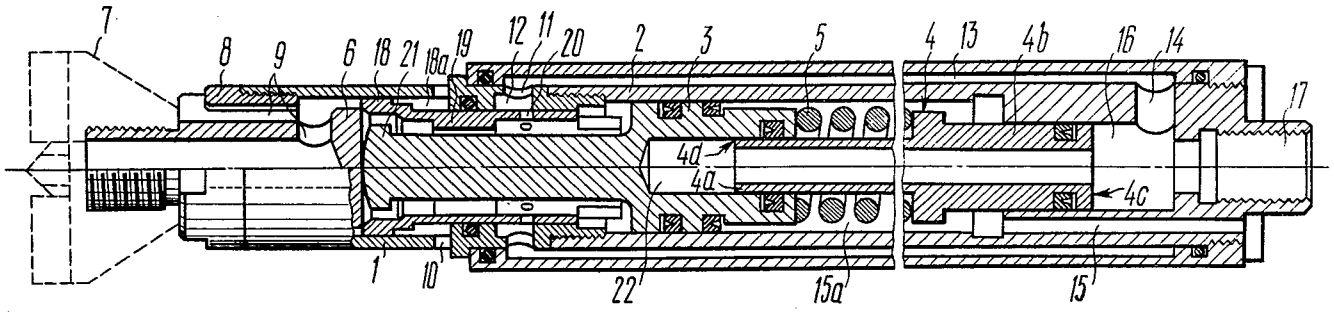
FIG. 3 is a longitudinal cross-section view of a hydraulic percussive machine, according to the invention, whose piston end face directed towards the machine rear portion is not pressed against the housing during forward and return strokes of the piston.

A hydraulic percussive machine shown in FIGS. 1, 2 and 3 may be used as a hydraulic hammer (quartering hammer) and a percussive device for making holes and deep wells in soil when employing a tool rotating means and a respective tool.

The hydraulic percussive machine has a stepped housing 1 adjoining the front portion of the machine and housing 2 adjoining the rear portion thereof.

A larger diameter hammer piston 3 adjoining the front portion of the machine and a smaller diameter plunger 4 adjoining the rear portion thereof are arranged in the housings 1 and 2 to be axially movable thereinside.

Arranged between the hammer piston 3 and plunger 4 is a cylindrical compression spring 5.

Secured in the housing 1 at the machine front portion is an anvil 6 fastened to a tool 7 for making holes and deep wells.

During operation of the machine, the hammer piston 3 end face directed to the machine front portion applies impacts to the anvil 6 which transmits it to the structure being destroyed vi the tool 7.

The housing 1 is closed with a cover made in the form of a splined nut 8 accommodating the anvil 6. Discharge passages 9 are made in the splined nut 8 and in the anvil 6. The housing 1 is provided with passages 10, 11 and an annular groove 12.

The housing 2 has passages 13, 14, 15, space 16 and connection 17 which serve (but for the passage 15) together with the passage 11 and annular groove 12 for supply of the pressure fluid to the supply and return spaces respectively.

The passage 15 connects the annular compensating space 15*a* which is not subject to the fluid pressure with the housing 2. This rules out formation of a water cushion in said space due to seepage of the pressure fluid from the inside of the machine through the packing glands; otherwise, said fluid might brake the movement of the hammer piston 3 during the return stroke (in the direction away from the tool).

The machine housing 2 is attached by the connection 17 to the string of drilling pipes (not shown) wherethrough the pressure fluid is fed to the machine. The hydraulic percussive machine is rotated by a separate rotating mechanism (not shown) arranged at the well mouth via the string of drilling pipes.

If the machine is employed as a hydraulic hammer for driving in piles, forging or destroying various structures, when no rotating mechanism is needed, the connection 17 is coupled with the pressure pipeline by a special reinforced hose (not shown).

Mounted in the housing 1 on the hammer piston 3 is a pressure difference ring valve 18 with an internal eccentric annular projection 19 and passages 20 which serve for admitting the pressure fluid into the supply return space of the housings 1 and 2 for effecting the return stroke (in the direction away from the tool).

The hammer piston 3 front portion has an annular projection 21, while the rear portion thereof has an axial cylindrical chamber 22 whose section area is smaller than that of the piston back face effective area.

The axial cylindrical space 16 is made in the housing of the machine rear portion. The plunger 4 is made hollow and has a hollow cylinder 4*a* at one end thereof; said cylinder being adapted for axial displacement in said cylindrical chamber 22 of the hammer piston 3, and a hollow cylinder 4*b* at the other end thereof, which is also adapted for axial displacement in said space 16 of the housing. The space 16 section area is smaller than the area of the piston back face, the area of the end face 4*c* of the hollow cylinder 4*b* located in the space 16 of the housing 2 exceeding the area of the end face 4*d* of the hollow cylinder 4*a* located in the cylindrical chamber 22 of the hammer piston 3.

Such a design of the machine rules out the necessity for damping the hydraulic shocks by a special damper (cavity) which is usually arranged at a certain distance from the machine on the pipeline whereby the pressure fluid is delivered thereto. This increases the machine efficiency since the hydraulic shocks at the forward and return strokes of the hammer piston 3 transmit their energy via the piston 4 to the spring 5 which relays said energy to the hammer piston during the forward stroke.

The inner annular projection 19 of the valve 18 is offset from the machine longitudinal axis and its internal diameter exceeds the diameter of the annular projection 21 of the hammer piston 3 by the run fit clearance.

This is done to ensure that the valve 18 can be fitted through the annular projection 21 to the expanded part of the hammer piston 3 outside the machine but does not slip off from said part during operation of the assembled machine by engaging the projection 21 of the hammer piston with its projection 19. Inasmuch as the valve 18 is made with the eccentric projection, the hammer piston 3 separates the valve 18 from the anvil 6 at the end of its return stroke (in the direction away from the tool).

Figure 4:
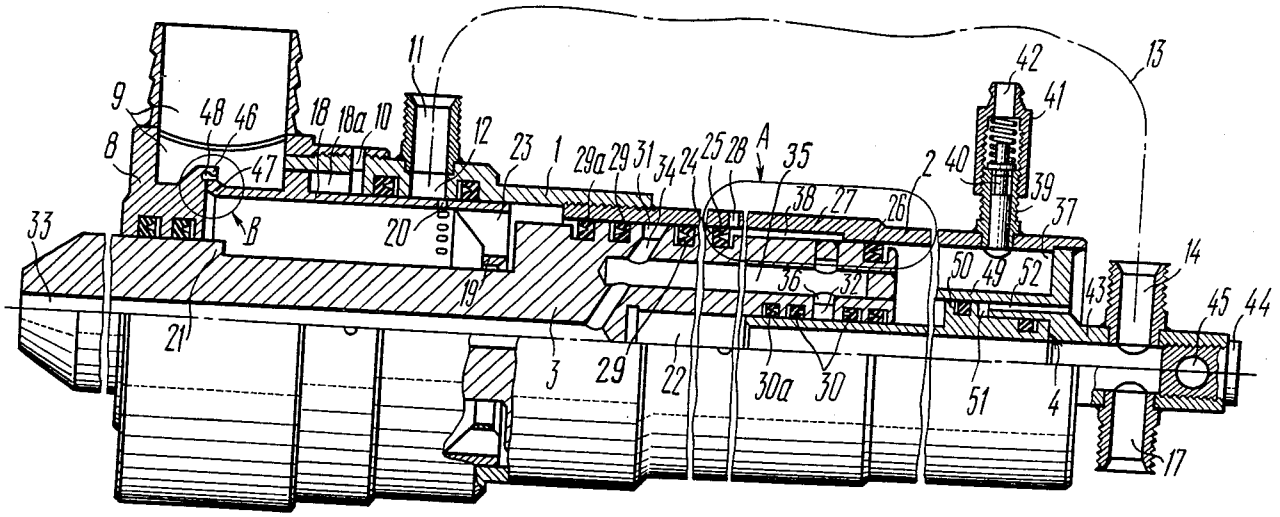
FIG. 4 is a longitudinal view partially in section of a hydraulic percussive machine according to the invention made in the form of a hydraulic hammer (quartering hammer)
Figure 5:
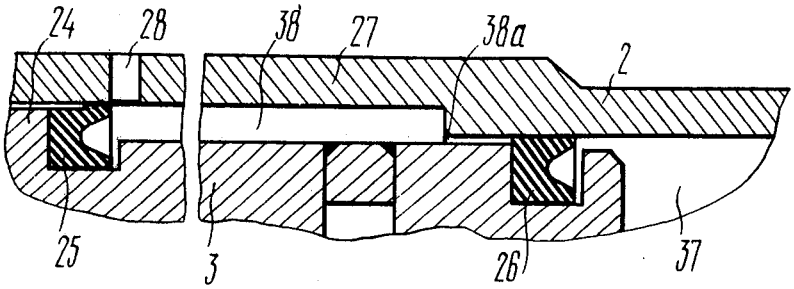
FIG. 5 is an enlarged view of area A of FIG. 4.

The hydraulic percussive machine shown in FIGS. 4 and 5 may be used only as a hydraulic hammer (quartering hammer) for destroying various structures, forging metals, driving in piles and the like. The impacts are applied by the end face of the front poortion of the hammer piston 3.

Constructionally the hydraulic hammer is somewhat different from the hydraulic machine shown in FIGS. 1 through 3.

The additional fluid passages 23 are made in the eccentric annular projection 19 of the hydraulic hammer pressure different valve 18. The hammer piston 3 is made with additional packing glands 25, 26 and an additional annular projection 24, while the housing 2 has a respective step 27 and suction passages 28. Provided between mating rubber packing glands 29 and 30 of the hammer piston 3 outer and inner surfaces which seal two different media (fluid and compressed air) are annular grooves 31 and 32 connected to each other and to the atmosphere by passages 33, 34, 35, 36. This is intended to remove fluid seeped through packing glands **29*a*, 29, 30*a*, 30 to the atmosphere to prevent ingress thereof into the receiver cavity 37 filled with compressed air supplied from the atmosphere by the annular projection 24 of the hammer piston 3 which moves together with the packing gland 25 in the annular cavity 38 of the additional step 27 of the housing 2**.

The compressed air is delivered during the return stroke of the hammer piston 3 through the annular gap **38*a* (FIG. 5) between the housing 2 and the hammer piston 3 and then through the packing gland 26 whose edges face the receiver cavity 37 and operate as a non-return valve. Provided in the housing 2 near the receiver cavity 37 is a connection 39 which accommodates a check (release) spring-loaded valve 40, which is adjusted for a definite pressure of the compressed air in the cavity 37 by the nut 41 with the passage 42**.

The cover 43 is closed with a bolt 44. The bolt has a through hole 45 for attachment of a cable (not shown) to suspend the hydraulic hammer in operation.

Figure 6:
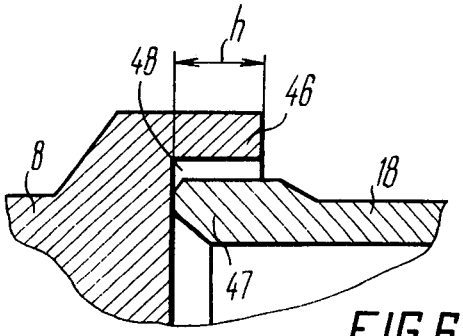
FIG. 6 is an enlarged view of area B of FIG. 4.

The cover 8 of the housing 1 before the valve 18 is provided with an annular projection 46 (FIGS. 4, 6) which embraces the valve 18 projection 47 directed towards the tool and forms an annular gap 48 for passing the fluid between its inner surface and the outer side surface of the front projection 47 of the valve 18. Due to this, the valve operates at the initial stage of its return stroke towards the machine rear portion until passages 20 are overlapped at any increased section area of the discharge passages 9 and maximum pressure of the compressed air in the receiver cavity 37 that increases the efficiency and reliability of the machine. The valve "*h*" of the projection 46 protrusion through the plane of the valve 18 adjoining the cover 8 is assumed to equal or exceed the diameter of the passages 20 of the valve 18 by 1.5–2.

The valve 18 section area at the projection 47 exceeds that of the rear portion of the valve.

The cover 43 (FIG. 4) of the housing 2 has an additional step 49 which receives an additional annular projection of the hollow plunger 4. The area of the annular projection 50 not compensated by the pressure is in the annular space 51 of the cover 43 which communicates with the atmosphere via passages 52. The additional step 49, projection 50 and space 51 with passages 52 are necessary only if replacing the spring with compressed air or other gaseous agent whose pressure should always be below the pressure of the working fluid so that the hammer piston is shifted back towards the machine rear portion during a return stroke thereof; therefore the area of the hollow plunger 4 end face acted upon by the compressed air or other gaseous agent should exceed the difference of the areas of its end faces acted upon by the fluid, otherwise the plunger 4 cannot be retained in the extreme position shown in FIG. 4 between the hydraulic shocks which is necessary for a trouble-free operation of the machine.

To describe the machine operation the position shown in FIG. 1 is assumed to be the initial one.

When in this position, the valve 18 is pressed against the anvil 6, the discharge passages are shut-off, while the passages 20 of the valve are opposite the annular groove 12 thus connecting the return space of the housings 1 and 2 via the passages 20, annular groove 12, passages 11, 13, 14 with the supply spaces 16, 22 and the pressure pipeline (string of drilling pipes or reinforced hose).

The pressure fluid from the delivery pipeline (not shown) via the connection 17 arrives at the supply spaces 16, 22 and via passages 14, 13, 11, 12, 20 to the return space of the housings 1 and 2, shifts the hammer piston 3 backward (rightward in the drawing) due to the difference of the areas of the end faces whereon the pressure fluid acts: the piston back face area is larger than the piston head face area corresponding to the section area axial chamber 22. The hammer piston 3 effects its return stroke compressing the spring 5.

After passing the preset distance the hammer piston 3 engages the inner eccentric annular projection 19 of the valve 18 by its annular projection 21 and separates the valve from the anvil 6 thus opening the discharge passages 9.

Then the valve 18 continues moving backward independently under the pressure of the fluid flowing from the return space due to the difference of the area of the valve opposite end faces which corresponds to the area of the valve 18 not subject to the fluid pressure and being in the annular gap **18*a* of the housing 1 coupled wth the atmosphere via the passages 10**.

At the beginning of the backward movement of the valve 18, its passages 20 displace relative to the annular groove 12 and get rapidly overlapped by the cylindrical walls of the housing 1, the hammer piston 3 stops and the hydraulic shock above the hammer piston and in the pressure pipeline is transmitted to the hammer piston 3 through the larger end face **4*e* of the plunger 4 and spring 5, and directly through the bottom of its axial chamber 22**.

The hydraulic shock and the fluid excess pressure exerted on the bottom of the chamber 22 as well as the releasing spring 5 make the hammer piston rush forward (leftward in the drawing) discharging the fluid from the return space of the housings 1 and 2 outside through the open annular gap between the housing 1 and anvil 6 and then through the discharge passages.

The hammer piston 3 meets the valve 18 approaching by the pressure of the discharge fluid, carries the valve along, applies impact against the anvil 6 secured with the tool 7, presses the valve 18 to the anvil 6, thus ceasing expelling of the fluid outside from the return space of the housings 1 and 2 and the hydraulic shock occuring again in the pressure pipeline is then transmitted via the passages 20 of the valve 18 into the return space of the housings 1 and 2.

The hydraulic shock and excess pressure forces make the hammer piston 3 effect the return stroke and the cycle repeats.

The hydraulic percussive machine shown in FIG. 3 is of the same design and is based on the same operating principle as the above-disclosed machine shown in FIG. 1, the only difference residing in that the spring 5 (FIG. 3) does not press the plunger 4 against the rear portion of the housing 2 during the forward and return strokes of the hammer piston, the rearmost position of the hammer piston 3 (in the direction away from the tool) includes a free space, due to which the plunger 4 has an easy backward stroke effected together with the hammer piston 3 and spring 5 during the return stroke of the hammer piston. Only with the hammer piston in the extreme positions, when the hydraulic shocks are formed, does the plunger 4 with spring 5 serves to damp the hydraulic shocks. The damped energy of the hydraulic shocks is transmitted via the spring 5 to the hammer piston 3 which relays it to the anvil 6 simultaneously with the energy of the hydraulic shocks and the excess pressure of the fluid delivered through the bottom of the chamber 22.

The embodiment of the machine shown in FIG. 3 has no advantages over the embodiment of FIG. 1 as to the efficiency or other characteristics thereof. This embodiment is preferably used when the machine is to have a small cross section to drill minimum diameter wells (70–80 mm).

In the latter case the return space of the hammer-piston 3 exceeds but slightly the supply space thereof and the pressure of the fluid exerted on the hammer piston 3 during its return strokes may prove insufficient for overcoming the resistance of the spring arranged according to FIG. 1. Therefore, it is preferable that the plunger 4 is arranged without being pressed by the spring 5 to the rear portion of the housing 2 and with a free space for ensuring a backward motion of the plunger 4 to exceed the stroke of the hammer piston 3, i.e. as illustrated in FIG. 3.

The operating principle of the hydraulic percussive machine shown in FIG. 4 is the same as that of the machine of FIGS. 1 and 3, the only difference consisting in that the hammer piston impacts are applied to the object being destroyed directly by the hammer piston back face, while the spring 5 found in the embodiment of FIGS. 1 and 3 is replaced in the machine of FIG. 4 by the compressed air which is delivered automatically by the hammer piston 3 during the return stroke thereof to the receiver cavity 37 of the housing 2 which does not contact the fluid.

What is claimed is:

1. A hydraulic percussive machine, comprising: a housing with fluid passages having an axial cylindrical chamber at the rear portion thereof; a stepped hammer piston adapted to move axially in said housing, resiliently urged with its smaller diameter end portion against the front portion of the machine and reciprocating under the action of pressurized fluid to effect forward and return strokes and to apply impacts during said forward strokes against a tool mounted in said housing at the front portion of the machine, the larger diameter end portion facing the rear portion of the machine has an axial cylindrical chamber whose section area is smaller than the larger diameter end face effective area; a hollow plunger adjoining the rear portion of said machine, having a diameter smaller than that of said hammer piston and being telescopingly associated therewith, and said plunger arranged in said housing so as to be axially movable therein and to effect reciprocations to increase power of impacts applied to said tool during said forward strokes of said hammer piston, said hollow plunger having a first hollow cylinder at one end thereof and said first hollow cylinder being arranged to be axially movable in said cylindrical chamber of said hammer piston, and a second hollow cylinder at the other end of said hollow plunger adapted to move axially in said cylindrical chamber of the housing, the section area of said cylindrical chamber of said housing being smaller than the area of the under-hammer-piston space, the area of the second hollow cylinder end face located in the cylindrical chamber of the housing exceeding the area of the end face of the first hollow cylinder arranged in the cylindrical chamber of the hammer piston; resilient means arranged between said hammer piston and said plunger being adapted to be compressed during the return stroke of said hammer piston and expanded at the forward stroke thereof to act on said hammer piston thereby increasing the power of the impact thereof; said housing having passages for admitting and discharging the pressurized fluid and passages for passing said fluid in the walls thereof; and a pressure difference stepped ring valve fitted concentrically around said hammer piston and also reciprocating to distribute the pressurized fluid through said passages of said housing between the return space and the atmosphere.

2. A hydraulic percussive machine, comprising: a housing with fluid passages; a stepped hammer piston adapted to move axially in said housing, resiliently urged wth its smaller diameter end portion against the front portion of the machine and reciprocating under the action of pressurized fluid to effect forward and return strokes and to apply impacts during said forward strokes against a tool mounted in said housing at the front portion of the machine; a hollow plunger adjoining the rear portion of said machine, having a diameter smaller than that of said hammer piston and being telescopingly associated therewith, and said plunger arranged in said housing so as to be axially movable therein and to effect reciprocations to increase power of impacts applied to said tool during said forward strokes of said hammer piston; resilient means arranged between said hammer piston and said plunger being adapted to be compressed during the return stroke of said hamer piston and expanded at the forward stroke thereof to act on said hammer piston thereby increasing the power of the impact thereof; an annular projection provided on the outer side surface of the hammer piston forming, together with a corresponding step on the inner surface of said housing, an annular chamber, the housing wall at this step having passages for connection of said annular chamber with the atmosphere when said hammer piston is in the foremost position in the direction to the tool, said hammer piston, during its return stroke in the direction away from said tool, compressing by said projection the air received in the annular chamber through said passages and delivering it through an annular gap between said housing and said hammer piston to the space of the housing between said hammer piston and plunger to serve as said resilient means; said housing having passages for admitting and discharging the pressurized fluid and passages for passing said fluid in the walls thereof; and a pressure difference stepped ring valve fitted concentrically around said hammer piston and also reciprocating to distribute the pressurized fluid through said passages of said housing between the return space and the atmosphere.

* * * * *